United States Patent [19]

Torikai et al.

[11] 4,008,144

[45] Feb. 15, 1977

[54] METHOD FOR MANUFACTURING OF ELECTRODE HAVING POROUS CERAMIC SUBSTRATE COATED WITH ELECTRODEPOSITED LEAD DIOXIDE AND THE ELECTRODE MANUFACTURED BY SAID METHOD

[75] Inventors: Eiichi Torikai, Yao; Yoji Kawami, Kawachi-Nagano, Japan

[73] Assignee: Agency of Industrial Science & Technology, Tokyo, Japan

[22] Filed: Aug. 21, 1975

[21] Appl. No.: 606,351

[30] Foreign Application Priority Data

Aug. 22, 1974 Japan ..... 49-96889

[52] U.S. Cl. ..... 204/290 R; 204/30; 204/38 R; 204/57; 204/291; 429/228

[51] Int. Cl.[2] ..... C25B 1/30; C25B 11/16

[58] Field of Search ..... 204/30, 57, 290 R, 290 F, 204/38 R

[56] References Cited

UNITED STATES PATENTS

| | | | |
|---|---|---|---|
| 1,510,173 | 9/1924 | Hosenfeld | 204/286 |
| 2,872,405 | 2/1959 | Miller et al. | 204/290 F |
| 2,994,649 | 8/1961 | Morrison et al. | 204/57 |
| 3,207,679 | 9/1965 | Schmidt | 204/42 |
| 3,607,681 | 9/1971 | Cooke et al. | 204/30 |
| 3,668,085 | 6/1972 | Kiyohara et al. | 204/57 |

FOREIGN PATENTS OR APPLICATIONS

| | | | |
|---|---|---|---|
| 2,119,570 | 10/1972 | Germany | 204/57 |

*Primary Examiner*—F.C. Edmundson
*Attorney, Agent, or Firm*—Oblon, Fisher, Spivak, McClelland & Maier

[57] ABSTRACT

An electrode having a lead dioxide coat electrodeposited on a porous ceramic substrate is manufactured by soaking a porous ceramic substrate in an aqueous lead (II) salt solution and thereby allowing lead oxide to be deposited in the porous surface layer and on the surface of the substrate thereafter soaking said porous ceramic substrate in a persulfate solution to cause oxidation of the lead oxide so deposited therein and thereon and effecting electrolysis in an aqueous lead (II) salt solution by using said lead dioxide-coated substrate as the anode and the aqueous solution as the electrolyte and thereby causing lead dioxide to the additionally electrodeposited on said lead dioxide coat.

The electrode manufactured as described above excels in corrosion-resisting property and therefore proves quite advantageous as an electrode for use in the electrolysis of aqueous solutions.

8 Claims, 2 Drawing Figures

METHOD FOR MANUFACTURING OF ELECTRODE HAVING POROUS CERAMIC SUBSTRATE COATED WITH ELECTRODEPOSITED LEAD DIOXIDE AND THE ELECTRODE MANUFACTURED BY SAID METHOD

BACKGROUND OF THE INVENTION

This invention relates to a method for the manufacture of an electrode excelling in corrosion-resisting property and having a porous ceramic substrate coated with electrodeposited lead dioxide and to the electrode manufactured by said method. There are the following three types of lead dioxide electrodes known to the art:

a. The type of electrodes produced by having lead dioxide anodically deposited on the surface of a lead substrate.

b. The type of electrodes formed solely of lead dioxide without using any substrate.

c. The type of electrodes produced by having lead dioxide electrodeposited on the substrate of a corrosion-resisting substance other than lead.

Of these three types, those of types b and c are called electrodeposited lead dioxide electrodes and they excel over those of type a in terms of corrosion-resisting property. They have already been put to practical use as electrodes convenient for the electrolysis of aqueous solutions.

The electrodeposited lead dioxide electrodes generally available on the market include rectangular lead dioxide electrodes devoid of a substrate and lead dioxide electrodes possessed of a substrate of graphite, titanium or tantalum or a substrate of such metal having the surface thereof plated with platinum, gold or silver. At the present, lead dioxide electrodes using a titanium substrate are enjoying favorable acceptance in the market.

The electrodeposited lead dioxide electrodes described above have their demerits: For example, the type of lead dioxide electrodes using no substrate are susceptible to fracture and therefore have their shape and dimensions inevitably limited and the type of electrodes using a graphite, titanium or tantulum substrate easily sustain cracks. When a crack occurs in such an electrode in the course of an electrolytic reaction, the solution undergoing the electrolysis penetrates through the crack and eventually comes into contact with the underlying substrate, with the result that the substrate is corroded by the solution. The crack, therefore, has an adverse effect on the service life of the electrode.

A primary object of the present invention is to provide a method for the manufacture of an electrodeposited lead dioxide electrode which incorporates a substrate of high corrosion-resisting property and therefore permits desired electrolysis to be performed without entailing troubles for a long time.

Another object of the present invention is to provide electrodeposited lead dioxide electrodes which enjoy high resistance to corrosion and withstand use conditions for a long time.

SUMMARY OF THE INVENTION

To accomplish the objects described above, the present invention provides a method which comprises soaking a porous ceramic substrate in an aqueous led (II) salt solution, then soaking said substrate desirably in an aqueous persulfate solution incorporating aqueous ammonia or in an aqueous persulfate solution incorporating an alkali metal hydroxide and thereafter drying the wet substrate. In consequence of the treatment described above, lead dioxide is deposited on the surface and in the porous surface layer of the porous ceramic substrate.

As the next step, electrolysis is effected by using, as the anode, the porous ceramic substrate having lead dioxide deposited as mentioned above and, as the electrolyte, an aqueous lead (II) salt solution. By this electrolysis, a black, fine-grained coat of lead dioxide excellent in electroconductivity is additionally formed to coat the lead dioxide layer covering the porous ceramic substrate.

Consequently, there is obtained an electrodeposited lead dioxide electrode which is constructed of a ceramic substrate and a layer of lead dioxide formed to coat the surface of said ceramic substrate. This electrode has excellent electroconductivity. Even if a crack occurs in the coat of lead dioxide while the electrode is in use, the electrolysis under way is not interrupted by the crack because the ceramic substrate offers perfect resistance to the action of the electrolyte.

DETAILED DESCRIPTION OF THE INVENTION

Figure 1:
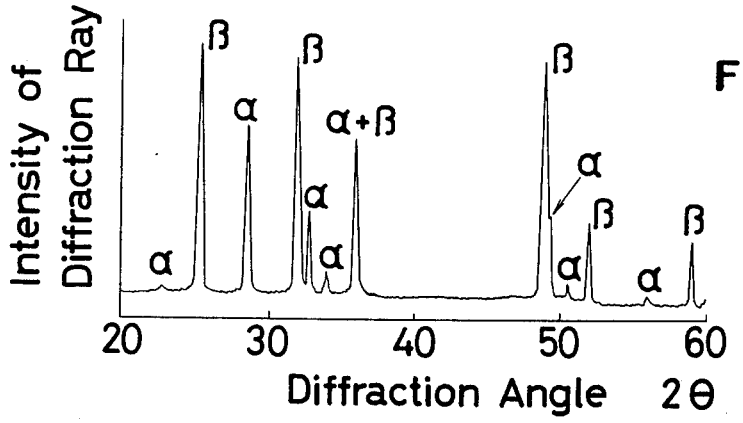
FIG. 1 is an X-ray diffraction diagram indicating the structure of electrodeposited lead oxide.

A ceramic substance is a very poor conductor of electricity. Therefore, lead dioxide cannot be electrodeposited directly on the ceramic substance.

For the formation of electroconductive films on the surface of ceramic articles, there have heretofore been proposed methods resorting to techniques such as chemical plating, vacuum evaporation and thermal decomposition. The process which comprises plating a given ceramic substrate in advance such as with platinum or silver by one of such methods and thereafter causing led dioxide to be electrodeposited thereon is easy to accomplish. It is, however, not advantageous from the economical point of view.

The method of the present invention is characterized by first inducing deposition of lead dioxide by a chemical process or a soaking process so as to give rise to an electroconductive layer on the surface of a ceramic substrte which is intrinsically a poor conductor of electricity prior to causing electrodeposition of lead dioxide on said surface, and subsequently permitting the formed layer of lead dioxide to achieve growth by means of electrolysis and thereby producing a fine-grained electrode excellent in electroconductivity and advantageous for actual uses.

Since the electrode according to the present invention uses a substrate of ceramic substance, it offers high resistance to corrosion and can be produced in any desired shape and dimensions.

A porous substance produced by sintering silica, alumina, magnesia, zirconia, calcia, etc. is used as a ceramic material for the production of the substrate in the electrode of the present invention. The ceramic material may be made from either one member or from a mixture of a plurality of members selected from the group mentioned above. It is quite easy for such a ceramic material to be molded to any desired shape so as to suit the purpose for which the finally produced electrode is to be used.

Since the ceramic substrate thus molded is a poor conductor of electricity, it is subjected to a treatment to impart desired electroconductivity to the surface thereof. And this treatment is carried out in accordance with the method disclosed by the same inventors in Japaneses Patent Publication No. 20164/1970. To be specific, the porous ceramic substrate molded to a desired shape is soaked in an aqueous lead (II) salt solution at temperatures from normal room temperature to 100° C, preferably from 50° to 80° C, for a period of not less than 5 minutes and not more than 1 hour. The aqueous lead (II) salt solution is desired to be an aqueous solution of a water-soluble lead salt such as, for example, lead nitrate, lead acetate, lead perchlorate or lead sulfamate.

At the end of said soaking, said ceramic substrate is taken out of said aqueous lead (II) salt solution and dried. This drying may be accomplished either by allowing the wet substrate to stand at normal room temperature or by being heated if accelerated drying is required. While the ceramic substrate is standing in the aqueous lead (II) salt solution, this solution penetrates into the porous surface layer of the substrate and adheres to the surface thereof as well. When the substrate is removed from the solution and then left to stand, the solution deposited in said surface layer and on the surface dries up to give rise to a uniform deposit of said lead (II) salt in the form of crystals.

Thereafter, the dried substrate is again soaked in an ammoniacal aqueous persulfate solution or an alkaline aqueous persulfate solution to cause oxidation of the lead salt deposited on the surface.

The aqueous persulfate solution incorporating aqueous ammonia to be used for said oxidation is obtained by preparing an aqueous 8–10% ammonia solution and adding to this solution such an amount of a persulfate to give a persulfate concentration of 5 to 6%. The concentrations of ammonia and persulfate mentioned above may be increased so as to suit the particular amount of the deposited lead dioxide desired to be oxidized on the surface of the substrate.

The soaking in the aqueous persulfate solution incorporating the aqueous ammonia is required to be given for not less than 50 minutes up to 1.5 hours, with the solution temperature kept between normal room temperature and 60° C, preferably between 50° and 60° C.

Examples of the persulfate, of which the aqueous solution is used for this oxidation, generally include persulfates of ammonium, sodium, potassium, etc.

The aqueous persulfate solution incorporting an alkali metal hydroxide is obtained by adding a persulfate such as of ammonium, sodium or potassium to an aqueous solution of the hydroxide of an alkali metal such as sodium or potassium in such relative amounts that, in the finally produced aqueous solution, the alkali metal oxide concentration falls in the range of from 20 to 40 g/liter and the persulfate concentration in the range of from 60 to 100 g/liter respectively, with the pH value of the solution maintained between 13 and 11.

As the result of the aforementioned treatment, crystals of lead dioxide are deposited on the surface of the substrate and in the pores distributed in the surface layer to a depth of several millimeters of the substrate.

Figure 2:
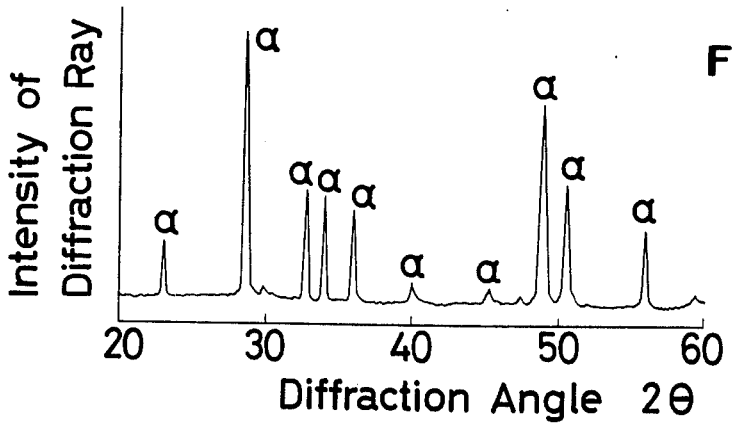
FIG. 2 is an X-ray diffraction diagram indicating the structure of lead dioxide deposited by the soaking process.

FIG. 2 is an X-ray diffraction diagram of the lead dioxide crystals deposited as described above. The horizontal axis is graduated for diffraction angle 20 and the vertical axis for the intensity of diffraction ray. From the diffraction diagram, it is seen that the lead dioxide is substantially composed of $\alpha$-lead dioxide. If the formed layer of deposited lead dioxide does not have sufficient thickness and the substrate fails to show sufficient electroconductivity, a desired electroconductive layer can be obtained by repeating the aforementioned step of oxidative soaking. This soaking process is nothing but an operation intended to impart sufficient electroconductivity to the substrate. A layer of lead dioxide having a thickness sufficient for the purpose of a practical electrode is not obtained, therefore, by merely repeating this process.

Desired growth of the layer of lead dioxide is accomplished by subsequently subjecting the substrate to the electrolytic process. This electrolytic process is effected as follows: In an electrolytic cell which contains, as the electrolyte, a lead (II) salt such as lead nitrate, lead perchlorate or lead sulfamate and, as the cathode, a piece of lead, copper or stainless steel (SUS 304, SUS 316, for example), the ceramic substrate which has been coated with lead dioxide in consequence of the aforementioned soaking process is disposed so as to function as the anode and electrolysis is effected.

For the purpose of this electrolysis, it is desired to use aqueous lead nitrate solution as the aqueous lead (II) salt solution and to conduct the electrolysis under the following general conditions: The lead nitrate concentration is to fall in the range of from 0.5 to 1.0 mole/liter of $Pb(NO_3)_2$, the pH value in the range of from 3.0 to 2.0, the solution temperature in the range of from 20° to 60° C and the anode current density in the range of from 0.5 to 20 A/dm$^2$.

The surface smoothness of the electrodeposited layer of lead dioxide is improved by adding to the electrolyte a nonionic surface active agent such as, for example, polyethylene oxide oleylether at a concentration of 5 to 8 g/liter. The lead ion concentration and the pH value of the electrolyte can be adjusted by addition of a basic lead carbonate.

Where the aqueous solution of any lead (II) salt other than lead nitrate is used as the electrolyte, the electrolysis is desired to be carried out under the following conditions: The lead (II) salt concentration is to fall in the range of from 0.5 to 1.0 mole/liter of electrolyte, the pH value in the range of from 2.0 to 3.0, the solution temperature in the range of from 20° to 60° C and the anode current density in the range of from 0.5 to 10 A/dm$^2$. The pH value is adjusted likewise by using a basic lead carbonate. Addition of a non-ionic surface active agent has a similar effect in improving the surface smoothness of the electrodeposited layer of led dioxide to the case of lead nitrate.

The thickness of the electrodeposited layer of lead dioxide to be formed on the ceramic substrate serving as the anode increases with the increasing length of the time of electrolysis. For the purpose of an electrode which is to be used in the electrolysis of ordinary aqueous solutions, the layer thickness is generally sufficient in the range of from 1 to 3 mm.

When the layer thickness has increased to reach a prescribed value, the electrolysis is stopped and the product of electrodeposition, namely the ceramic substrate now coated with the electrodeposited lead dioxide, is removed from the electrolytic cell and washed with water and dried. The drying is effected by first allowing it to stand at normal room temperature to 50° C for preliminary drying and then exposing it to a heat at 100° C. The layer of electrodeposited lead dioxide thus finally obtained is a fine-grained black coat excellent in electroconductivity. FIG. 1 shows an X-ray diffraction diagram of this product. The diagram clearly indicates that the product is an $\alpha + \beta$ lead dioxide.

A terminal attached at a proper position to the electrodeposited layer turns the product into a complete electrode ready for use.

EXAMPLE 1

A porous round bar of corundum (measuring 15mm in diameter and 300mm in height) was soaked in a saturated solution of lead (II) nitrate at 90° C for 5 minutes, then removed from the solution and left to dry at normal room temperature. Subsequently, the dried bar was placed in a solution which had been prepared by adding 30g of ammonium persulfate to 500ml of aqueous ammonia (obtained by diluting an aqueous 28% ammonia solution with water of a volume twice as large) and heating the resultant mixture to 50° to 60° C and left to stand therein and undergo an oxidation treatment for about 1 hour. At the end of this treatment, the bar was washed first with dilute nitric acid and then with water and dried at 100° C. Consequently, the bar was found to be coated with a layer of $\alpha$-lead dioxide penetrating to a depth of 2 to 3mm from the surface of the substrate.

Then, the substrate which had been coated with the layer of $\alpha$-lead dioxide as described above was disposed as an anode and a plate of stainless steel (SUS 304) was disposed as a cathode respectively in an electrolytic cell, which was filled with an aqueous 165 g/liter lead nitrate solution (with the pH value adjusted with nitric acid to 2.0). In this electrolytic cell, electrolysis was carried out at 25° C. The anode current density was fixed at 0.5 A/dm$^2$ in the initial phase of electrolysis and increased to a final level of 4–5 A/dm$^2$ within four hours of electrolysis. After that, the flow of electric current was continued for 24 hours, with the current density fixed at said final level.

Subsequently, said substrate used as the anode was taken out, washed with water and dried at 100° C. There was consequently obtained an electrodeposited lead dioxide electrode having a corundum substrate coated with a uniform 2.0-mm layer of blackish gray lead dioxide.

In an electrolytic cell divided into two compartments with an unglazed diaphragm, the electrodeposited lead dioxide electrode obtained as described above was disposed in the anode compartment and a lead plate of the same shape was disposed in the cathode compartment. With this electrolytic cell, production of iodic acid by electrolysis was tested under the following conditions: Anode liquid 500ml of 0.6N hydrochloric acid + 100g of powdered iodine, cathode liquid 500ml of 10% sulfuric acid, temperature 40° C, voltage 5V, electric current 7A, anode current density 14 A/dm$^2$. The flow of current was continued until 110.0 AH. Then it was discontinued and the anode liquid was evaporated to produce 134g of iodic acid. By calculation, the yield was found to be 96.7%, the current efficiency to be 92.8% and the anode consumption to be 0.4 g/100g of $HIO_3$. These results were substantially the same as those obtained by using a substrateless lead dioxide electrode.

The fact that the electrodeposited lead dioxide electrode according to the present invention has greater strength than the substrate-less electrodeposited lead dioxide clearly indicates that the former excels over the latter in terms of practical utility.

EXAMPLE 2

A porous plate of mullite (measuring 50 × 150 × 2mm) was soaked in an aqueous lead (II) nitrate solution by following the procedure of Example 1. The it was taken out of the solution and immediately dried. The dried porous plate was then placed in a 30 g/500 ml potassium persulfate solution and, with the pH value adjusted to 12–13 by incorporation of 2N aqueous temperatures of hydroxide solution, treated for 1 hour at temperaturesof from 50° to 60° C. Then the plate was washed with water and dried similarly to Example 1. The dried plate was found to be coated with a uniform layer of $\alpha$-lead dioxide having the same thickness as that obtained in Example 1 and penetrating into the surface layer of the porous substrate to a depth of 2 to 3mm from the surface. Subsequently, this plate was used to perform electrolysis and then treated in the same manner as before. Consequently, there was obtained an electrodeposited lead dioxide electrode having the porous substrate of mullite coated with a uniform compact layer of blackish gray lead dioxide having a thickness of 1.5mm.

With this electrode used as the anode, electrolysis was performed by faithfully following the procedure of Example 1. The electrolysis gave entirely the same results, indicating that the porous mullite substrate coated with the layer of lead dioxide served as an excellent electrodeposited lead dioxide electrode similarly to the electrode described in Example 1.

EXAMPLE 3

A porous plate of zirconia (measuring 50 × 150 × 3mm) was soaked in a solution of lead perchlorate (226 g/1000 ml) at 40° to 50° C for 10 minutes, then removed from the solution and dried at 50° C.

Subsequently, the dried plate was placed in a solution which has been prepared by adding 30g of ammonium persulfate to 500ml of aqueous ammonia (obtained by diluting an aqueous 28% ammonia solution with water of a volume twice as large) and heating the resultant mixture to 50° to 60° C and left to stand therein and undergo an oxidation treatment for 1 hour. At the end of this treatment, the plate was washed first with dilute nitric acid and then water and dried at 100° C.

After completion of this chemical treatment, the plate was used to conduct electrolysis under the same conditions as those described in Example 1. Consequently, as in Examples 1 and 2, there was obtained an electrodeposited lead dioxide electrode with a uniform compact layer of blackish gray lead dioxide having a thickness of 1 to 1.5mm.

What is claimed is:

1. A method for the manufacture of an electrodeposited lead dioxide electrode incorporating a porous ceramic substrate, which method comprises:

soaking a porous ceramic substrate in an aqueous lead (II) salt solution, removing said substrate from said aqueous solution and drying the substrate, soaking the dried substrate in one aqueous solution selected from the group consisting of an aqueous persulfate solution incorporating an aqueous ammonia and an aqueous persulfate solution incorporating an alkali metal hydroxide, and subsequently removing the substrate from said aqueous solution, washing and drying the substrate and thereby obtaining a composite having said ceramic substrate coated with a layer of lead dioxide consisting preponderantly of $\alpha$-$PbO_2$ and formed on the surface and in the porous surface layer of said porous substrate, and thereafter disposing said composite in an electrolytic cell containing an aqueous lead (II) salt solution as the electrolyte and incorporating, as the cathode, a piece of a metal selected from the group consisting of lead, copper and stainless steel, passing a flow of electric current having an anode current density of 0.5 to 20 A/dm$^2$ to effect electrolysis and thereby further coating the composite (ceramic substrate coated lead dioxide) with a layer of black compact lead dioxide of $\alpha + \beta$ form excelling in electroconductivity.

2. The method according to claim 1, wherein the substance of said porous ceramic substrate is at least one member selected from the group consisting of silica, alumina, magnesia, zirconia and calcia.

3. The method according to claim 1, wherein said aqueous persulfate solution incorporating said aqueous ammonia is an aqueous solution obtained by adding to an 8 to 10 weight percent aqueous ammonia solution one persulfate selected from the group consisting of ammonium persulfate, sodium persulfate and potassium persulfate in an amount to give a concentration of 5 to 6 percent by weight based on the finally produced aqueous solution.

4. The method according to claim 1, wherein said aqueous persulfate solution incorporating said alkali metal hydroxide is obtained by having an aqueous alkali metal solution contain therein one persulfate selected from the group consisting of ammonium persulfate, sodium persulfate and potassium persulfate, with the pH value adjusted in the range of from 11 to 13.

5. The method according to claim 1, wherein said aqueous lead (II) salt solution used as the electrolyte is one member selected from the group consisting of lead nitrate, lead perchlorate and lead sulfamate.

6. The method according to claim 5, wherein said electrolyte contains 0.5 to 1.0 mole/liter of $Pb(NO_3)_2$ and has a pH value in the range of 6.0 to 2.0 and a liquid temperature of 20° to 60° C.

7. An electrodeposited lead dioxide composite for use as an electrode, comprising a porous ceramic substrate, a layer preponderantly of $\alpha$-lead dioxide deposited on the surface and in the porous surface layer of the substrate, and a layer of $\alpha + \beta$ lead dioxide deposited on said deposited layer of $\alpha$-lead dioxide.

8. The electrodeposited lead dioxide composite for use as an electrode according to claim 7, wherein said porous ceramic substrate is at least one member selected from the group consisting of porous silica, alumina, magnesia, zirconia and calcia.

* * * * *